US007884839B2

(12) United States Patent
Hwang

(10) Patent No.: US 7,884,839 B2
(45) Date of Patent: Feb. 8, 2011

(54) METHOD AND SYSTEM FOR IMAGE PROCESSING FOR SPATIAL LIGHT MODULATORS

(75) Inventor: Michael Y. T. Hwang, Fremont, CA (US)

(73) Assignee: Miradia Inc., Santa Clara, CA (US)

( * ) Notice: Subject to any disclaimer, the term of this patent is extended or adjusted under 35 U.S.C. 154(b) by 1447 days.

(21) Appl. No.: 11/295,053

(22) Filed: Dec. 5, 2005

(65) Prior Publication Data

US 2007/0126759 A1 Jun. 7, 2007

(51) Int. Cl.
*G09G 5/10* (2006.01)

(52) U.S. Cl. ..... 345/691; 345/690; 345/692

(58) Field of Classification Search ..... 345/48, 345/57, 84, 87, 90, 100, 108, 475, 589, 530, 345/210, 690–692, 698; 348/759, 760, 771; 359/290, 292; 375/150, 238, 130, 213, 377; 353/33

See application file for complete search history.

(56) References Cited

U.S. PATENT DOCUMENTS 5,852,429 A * 12/1998 Scheffer et al. ..... 345/100
6,014,128 A * 1/2000 Doherty et al. ..... 345/589
6,064,404 A * 5/2000 Aras et al. ..... 345/530
6,144,356 A 11/2000 Weatherford et al.
6,151,011 A 11/2000 Worley, III et al.
6,326,980 B1 12/2001 Worley, III
6,774,916 B2 * 8/2004 Pettitt et al. ..... 345/691
7,050,122 B2 * 5/2006 Gibbon et al. ..... 348/771
7,164,397 B2 * 1/2007 Pettitt et al. ..... 345/63
7,576,759 B2 * 8/2009 Pettitt et al. ..... 345/691
2004/0001184 A1 * 1/2004 Gibbons et al. ..... 353/31
2005/0052703 A1 * 3/2005 Pettitt et al. ..... 358/3.19
2005/0068464 A1 * 3/2005 Pettitt et al. ..... 348/690
2005/0276502 A1 * 12/2005 Brown Elliott et al. ..... 382/254
2008/0007576 A1 * 1/2008 Ishii et al. ..... 345/691

* cited by examiner

*Primary Examiner*—Prabodh M Dharia
(74) *Attorney, Agent, or Firm*—Townsend and Townsend and Crew LLP

(57) ABSTRACT

A method of enhancing the gray scale resolution of a PWM system. The method includes defining an N-bit PWM sequence with a length of $2^N-1$ units. The N-bit PWM sequence includes a least significant bit (LSB) segment characterized by a temporal length of one unit. In some embodiments, the temporal length of one unit is referred to as a time $t_0$. The method also includes defining a fractional PWM sequence. The fractional PWM sequence includes the N-bit PWM sequence and a fractional bit segment of temporal length F. The temporal length of the fractional PWM sequence is $2^N-1+F$ units. In a particular embodiment, F=1 and the temporal length of the fractional PWM sequence is $2^N$.

6 Claims, 6 Drawing Sheets

METHOD AND SYSTEM FOR IMAGE PROCESSING FOR SPATIAL LIGHT MODULATORS

BACKGROUND OF THE INVENTION

This present invention relates generally to video display techniques. More specifically, the present invention relates to pulse width modulation methods used with spatial light modulators. Merely by way of example, the invention has been applied to a pulse width modulation method using an expanded bit plane. The methods and techniques can be applied to other applications as well such as liquid crystal displays and the like.

Reflective spatial light modulators (SLMs) are devices that modulate light in a spatial pattern to reflect an image corresponding to an electrical or optical signal. The incident light may be modulated in phase, intensity, polarization, or direction of deflection. A reflective SLM typically includes a two-dimensional array of addressable picture elements (pixels) capable of receiving and reflecting incident light. Source pixel data is first processed by an associated control circuit, then loaded into the pixel array one frame at a time.

In some SLM displays, the color depth or gray scale brightness produced by a given pixel is controlled using various forms of frame modulation methods. On such method of simulating color depth is pulse width modulation (PWM). One bit-per-pixel (bpp) display devices utilize either an "off" state or an "on" state. Thus, in some PWM systems, the length of time during which an individual pixel is either in the off or the on state is varied to produce gray scale images.

For example in one PWM system, a frame rate and matching frame period is determined based on the rate at which images will be displayed. The intensity resolution is determined for each pixel, with black being zero time slices and the smallest, or "least significant bit" (LSB) equaling one time slice. Then, each pixel's intensity is quantized to determine its appropriate on-time during the frame period. For each pixel with a quantized intensity value greater than zero, its on-time during the frame period equals the number of time slices that correspond to the desired pixel intensity.

FIG. 1A is a simplified field-pulse diagram illustrating a conventional display frame for a six-bit PWM technique with a total of 63 LSB fields. The display frame 105 with frame time 100 includes a total of 63 LSB fields 115. FIG. 1B is a simplified field-pulse diagram illustrating a conventional display frame with bits of various sizes. As illustrated in FIG. 1B, the display frame 120 includes bits of various sizes as marked with indicators ranging from 0-5. The shortest bit, referred to as the LSB 125 and marked with a 0, determines the size of the fields by which the various bits 1-5 are measured. The LSB 125 is shown as one LSB field long, as measured against FIG. 1A. The longest bit is referred to as the most significant bit (MSB) 130 and is marked with a 5. The MSB 130 is shown as 32 LSB fields long, as measured against FIG. 1A. The remainder of the bits 135-150 are in between these lengths, specifically, bit 1 (135) is two LSB fields long, bit 2 (140) is four LSB fields long, bit 3 (145) is eight LSB fields long, and bit 4 (150) is sixteen LSB fields long.

In order to address elements of the SLM, the PWM data is arranged in the form of bit planes that match the bit weights of the quantized intensity value. In the simplest instance, the bit planes each are loaded separately during a frame, with the pixels addressed according to their respective bit plane values. For example, the bit plane associated with the LSB of a pixel takes up one time slice in the frame. In contrast, the most significant bit (MSB) may take up several slices in the frame.

The human eye integrates the on and off segments or pulses of light produced by the SLM in a given frame, resulting in a perception of a gray scale brightness value for a given pixel. In general, the greater the number of shades of gray, the better gray scale, or eventually color, resolution is available to a viewer. However, increasing the gray scale resolution generally entails increasing the data rate required to load the data in bit planes. For example, if the number of gray scale resolution values is increased from 7-bit resolution ($2^7$=128 shades of gray) to 8-bit resolution ($2^8$=256 shades of gray), the data rate may be increased by a factor of two.

In some applications, an intermediate resolution which is greater than a present resolution, but less than a doubled resolution, may be acceptable for a given application. However, conventional methods of PWM as illustrated in FIGS. 1A and 1B do not provide for such intermediate resolutions. Thus, there is a need in the art for improved methods of performing PWM for display applications.

SUMMARY OF THE INVENTION

According to the present invention, video display techniques are provided. More specifically, the present invention relates to pulse width modulation methods used with spatial light modulators. Merely by way of example, the invention has been applied to a pulse width modulation method using an expanded bit plane. The methods and techniques can be applied to other applications as well such as liquid crystal displays and the like.

According to an embodiment of the present invention, a method of enhancing the gray scale resolution of a PWM system is provided. The method includes defining an N-bit PWM sequence with a length of $2^N-1$ units. The N-bit PWM sequence includes a least significant bit (LSB) segment characterized by a temporal length of one unit. The method also includes defining a fractional PWM sequence comprising the N-bit PWM sequence and a fractional bit segment of temporal length F. According to embodiments of the present invention, the temporal length of the fractional PWM sequence is $2^N-1+F$ units. In a particular embodiment, the fractional bit segment has a temporal length of one unit.

According to another embodiment of the present invention, a method of performing image processing for a spatial light modulator is provided. The method includes providing an N-bit pulse width modulation pattern. The N-bit pulse width modulation pattern is characterized by a first LSB segment and N−1 additional bit segments. The cumulative length of the N-bit pulse width modulation pattern is equal to $2^N-1$ times the first LSB segment. The method also includes providing an extended pulse width modulation pattern including the N-bit pulse width modulation pattern combined with a second LSB segment. According to embodiments of the present invention, the extended pulse width modulation pattern is characterized by a cumulative length of $2^N$ times the first LSB segment.

According to yet another embodiment of the present invention, a spatial light modulator is provided. The spatial light modulator includes a support member, a torsion spring hinge coupled to the support member, and a mirror plate coupled to the torsion spring hinge. The mirror plate is coplanar with the torsion spring hinge. The spatial light modulator also includes an electrode coupled to the support member and adapted to receive an extended PWM sequence comprising an LSB characterized by an LSB temporal duration and an additional bit. According to embodiments of the present invention, the temporal length of the N-bit PWM sequence is equal to $2^N$ times the LSB temporal duration and a first pulse in the N-bit PWM sequence actuates the mirror plate to rotate in relation to the torsion spring hinge.

According to an alternative embodiment of the present invention, a method of providing enhanced PWM for a SLM is provided. The method includes defining an N-bit PWM bit sequence including an LSB characterized by a temporal length and N−1 bit segments, each of the N−1 bit segments having a temporal length equal to $2^N$ times the temporal length of the LSB. The method also includes defining a modified PWM bit sequence by adding an additional LSB to the N-bit PWM bit sequence and defining a first portion of the modified PWM bit sequence. According to embodiments of the present invention, the first portion of the modified PWM bit sequence comprises bit segments characterized by a temporal length greater than or equal to 16 times the temporal length of the LSB. The method further includes providing 31 equal length bit segments by performing bit splitting of the first portion of the bit segments and providing a 32nd equal length bit segment by combining the LSB, the additional LSB, and the bit segments with a temporal length less than or equal to four times the temporal length of the LSB.

According to another alternative embodiment of the present invention, a method of reducing peak bandwidth in a PWM system for a SLM is provided. The method includes defining an N-bit PWM bit sequence including an LSB characterized by a temporal length and N−1 bit segments, each of the N−1 bit segments having a temporal length equal to $2^N$ times the temporal length of the LSB. The method also includes defining a modified PWM bit sequence by adding an additional LSB to the N-bit PWM bit sequence and defining a first portion of the modified PWM sequence. The first portion includes bit segments with length greater than four times the LSB. The method further includes providing 62 bit segments by bit splitting the first portion, scrambling and combining the 62 equal length bit segments to form 31 equal length bit segments, and providing a 32nd equal length bit segment by combining the LSB, the additional LSB, the bit segment with length equal to twice the LSB, and the bit segment with length equal to four times the LSB.

According to yet another alternative embodiment of the present invention, a method of increasing a gray scale resolution of a PWM system for a SLM is provided. The method includes defining an N-bit PWM bit sequence including an LSB characterized by an LSB temporal length and N−1 bit segments, each of the N−1 bit segments having a temporal length equal to a multiple of the LSB temporal length. The method also includes defining a modified PWM bit sequence by adding an additional LSB to the N-bit PWM bit sequence and providing an even frame including a first modified PWM bit sequence. The first modified PWM bit sequence is characterized by a first value of the additional LSB. The method further includes providing an odd frame including a second modified PWM bit sequence. The second modified PWM bit sequence is characterized by a second value of the additional LSB, thereby providing an average value of the additional LSB measured over the even frame and the odd frame.

Numerous benefits are achieved using the present invention over conventional techniques. For example, an embodiment of the present invention provides a flexible design that can be optimized to meet the needs of particular applications. For example, the distribution of gray scale values may be modified to reduce artifacts present in other pulse width modulation approaches. In addition, embodiments of the present invention provide for increased gray scale resolution without significant increases in the data rate of the PWM system. Moreover, according to embodiments of the present invention, an increase in gray scale resolution is not limited to a doubling of the resolution, but a variable length expansion is provided. Depending upon the embodiment, one or more of these benefits may exist. These and other benefits have been described throughout the present specification and more particularly below. Various additional objects, features, and advantages of the present invention can be more fully appreciated with reference to the detailed description and accompanying drawings that follow.

DETAILED DESCRIPTION OF SPECIFIC EMBODIMENTS

According to the present invention, video display techniques are provided. More specifically, the present invention relates to pulse width modulation methods used with spatial light modulators. Merely by way of example, the invention has been applied to a pulse width modulation method using an expanded bit plane. The methods and techniques can be applied to other applications as well such as liquid crystal displays and the like.

Embodiments of the present invention are utilized to provide electrical control signals for arrays of spatial light modulators (SLMs). In some applications of the present invention, arrays fabricated utilizing semiconductor processing and substrate bonding techniques as described in U.S. patent application Ser. No. 10/756,936, entitled "Reflective Spatial Light Modulator" and filed Jan. 13, 2004, U.S. patent application Ser. No. 10/756,923, entitled "Fabrication of a Reflective Spatial Light Modulator" and filed Jan. 13, 2004, and U.S. patent application Ser. No. 10/756,972, entitled "Architecture of a Reflective Spatial Light Modulator" and filed Jan. 13, 2004, which are commonly owned, and hereby incorporated by reference for all purposes. As described more fully in the above referenced applications, SLM has a reflective, selectively deflectable micro-mirror array fabricated from a first substrate bonded to a second substrate having individually addressable electrodes. The micro-mirrors and a torsion spring hinge about which the micro-mirrors rotate are fabricated from a single silicon substrate, for example, a single crystal silicon substrate. Embodiments of the present invention are not limited to use with these particular SLMs, but are applicable to a wide variety of SLM structures, as will be evident to one of skill in the art.

Figure 2A:
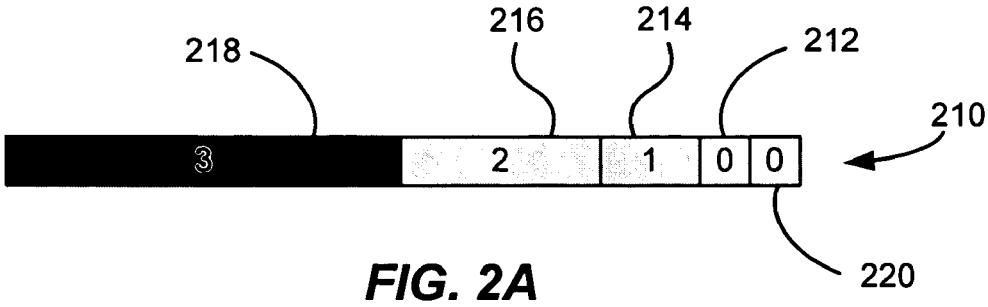
FIG. 2 is a simplified field pulse diagram of an expanded fractional bit plane PWM technique according to an embodiment of the present invention.

FIGS. 2A-2D are a simplified field pulse diagrams for an expanded bit plane PWM technique according to an embodiment of the present invention. As illustrated in FIG. 2A, a first PWM sequence 210 includes five bit segments or bit planes 212, 214, 216, 218, and 220. The series of bit planes illustrated in FIG. 2A corresponds to a PWM format utilizing N=4 and providing $2^N$ or 16 gray scale values, from 0-15 units. The temporal length of the LSB 212 is equal to one LSB unit ($t_0$). In a specific embodiment, the time $t_0$ is equal to about 10 μs, providing about 512 shades of gray scale resolution for three colors at a refresh rate of 60 Hz. The next most significant bit 214 with a length of $2t_0$ is represented by a bit labeled "1." The reference to "1" results from the length of the but being equal to $2^1$ times $t_0$. Bits "2" (216) and "3" (218) have lengths of four and eight times the LSB. In embodiments of the present invention, the number of bits is selected in relation to the gray scale resolution desired for the particular application.

Figure 1A:
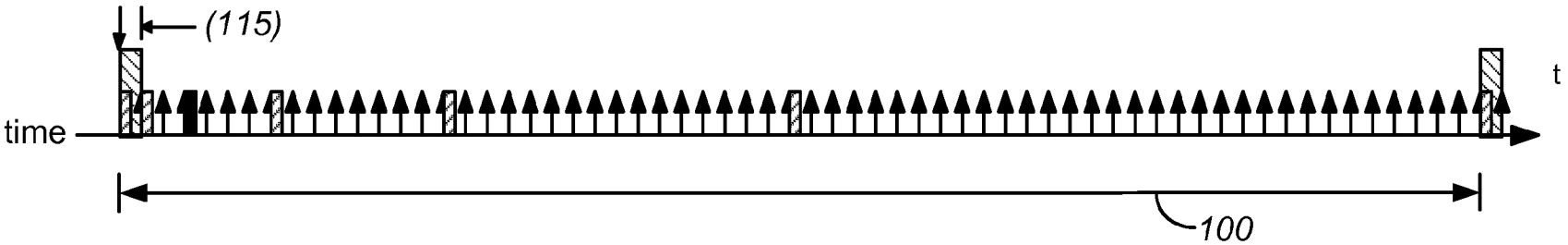
FIG. 1A (Prior Art)
FIG. 1A is a simplified field-pulse diagram illustrating a conventional display frame for a six-bit PWM technique with a total of 63 LSB fields.
Figure 1B:
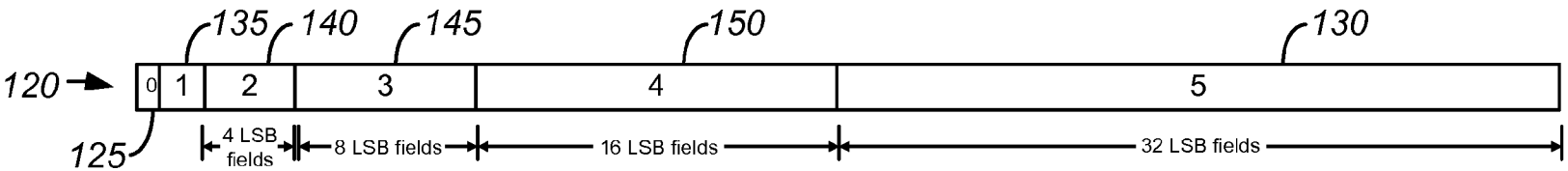
FIG. 1B (Prior Art)
FIG. 1B is a simplified field-pulse diagram illustrating a conventional display frame with bits of various sizes.

In conventional PWM techniques, as illustrated in FIG. 1B, the cumulative length of the bits in the display frame is equal to $2^N-1$. As shown in FIG. 1B, for an N=5 PWM sequence, the cumulative length of the bits 0-5 is $(2^5-1)t_0=63t_0$. Embodiments of the present invention provide expanded bit plane PWM techniques as illustrated in FIG. 2A. Referring once again to FIG. 2A, additional bit 220, with a length equal to the length of the LSB, $t_0$, is added to form an expanded bit plane sequence according to embodiments of the present invention. Adding the additional bit 220 increases the cumulative length of the PWM sequence illustrated in FIG. 2A to a value of $2^N$ (i.e., 64).

Figure 2B:
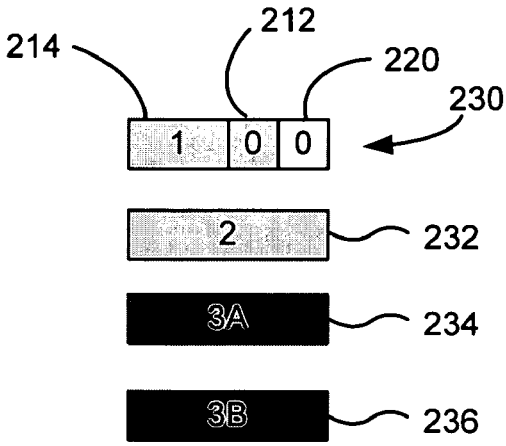

FIG. 2B illustrates a method of performing bit splitting using the expanded PWM sequence discussed with reference to FIG. 2A. Depending on the duration of expanded bit plane 220, new bit "2" (232) may not have same duration as bit plane 216 in FIG. 2A. Referring to FIG. 2B, bits "3A" (234), "3B" (236), and "2" (232) are generated by combining the original bit plane 3 (218), bit plane 2 (216), and the additional bit (220), subtracting the bit plane 0 (212), then dividing the resulting duration equally to generate even segments (bit planes 232, 234, and 236). If the expanded bit plane (220) has a duration equal to bit plane 0 (212) as illustrated in FIG. 2B, then the new bit "2" (232) has the same duration as the original bit "2" (216), the new bit "3," "3A" (234), and "3B" (236), have the same length, which is equal to the length of original bit plane 2 (216). Bit plane 1 214 along with the LSB 212 and the additional bit 220 (the LSB and the additional bit both have a length equal to that of the LSB), are combined to form a bit grouping (230) of length equal to $4t_0$. Accordingly, four bits 230, 232, 234, and 236 are formed, all with length equal to $4t_0$. According to embodiments of the present invention, these four bits are sequenced as illustrated in FIG. 2C.

Figure 2C:
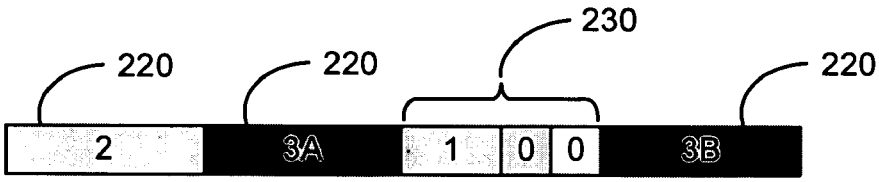

FIG. 2C is a simplified field pulse diagram illustrating a time-shifted PWM sequence according to an embodiment of the present invention. In FIG. 2C, bit 232 has been shifted forward in time, appearing at the front of the bit stream that fills the display frame. Bit 234 has been shifted backward in time by 4 LSB units to follow bit 232. Bit 230 has been shifted forward in time by 4 LSB units and bit 236 has been shifted backward in time by 8 LSB units to appear at the end of the modulation sequence. One of skill in the art will appreciate that the sequence illustrated in FIG. 2C is merely an exemplary sequence and is not intended to limit the present invention. As described more fully throughout the present specification, the merging, splitting, and sequencing of bits facilitates management and control of data rates, while maintaining a given gray scale resolution. One of ordinary skill in the art would recognize many variations, modifications, and alternatives.

Figure 2D:
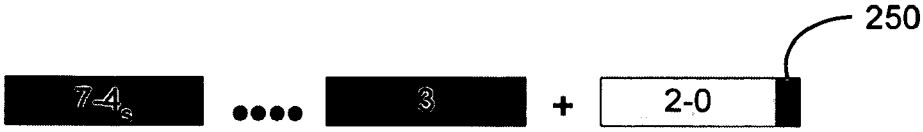

FIG. 2D illustrates a bit merging, splitting, and shifting PWM sequence for which N=8, providing 256 gray scale values. Bits "0" through "2" have been combined with an additional LSB bit 250 to form a bit grouping of length equal to 8 LSBs. Bits "4" through "7" have been split into bits of length equal to 8 LSBs to form a series of 30 split bits represented in FIG. 2D by the reference symbol "7-4$_S$," where "S" represents the splitting of these bits. According to embodiments of the present invention, the expanded bit plane illustrated in FIG. 2D, with a temporal length of $2^8=256$, provides 32 equal length segments, with a temporal length equal to $8t_0$, that are suitable for time shifting.

Figure 3:
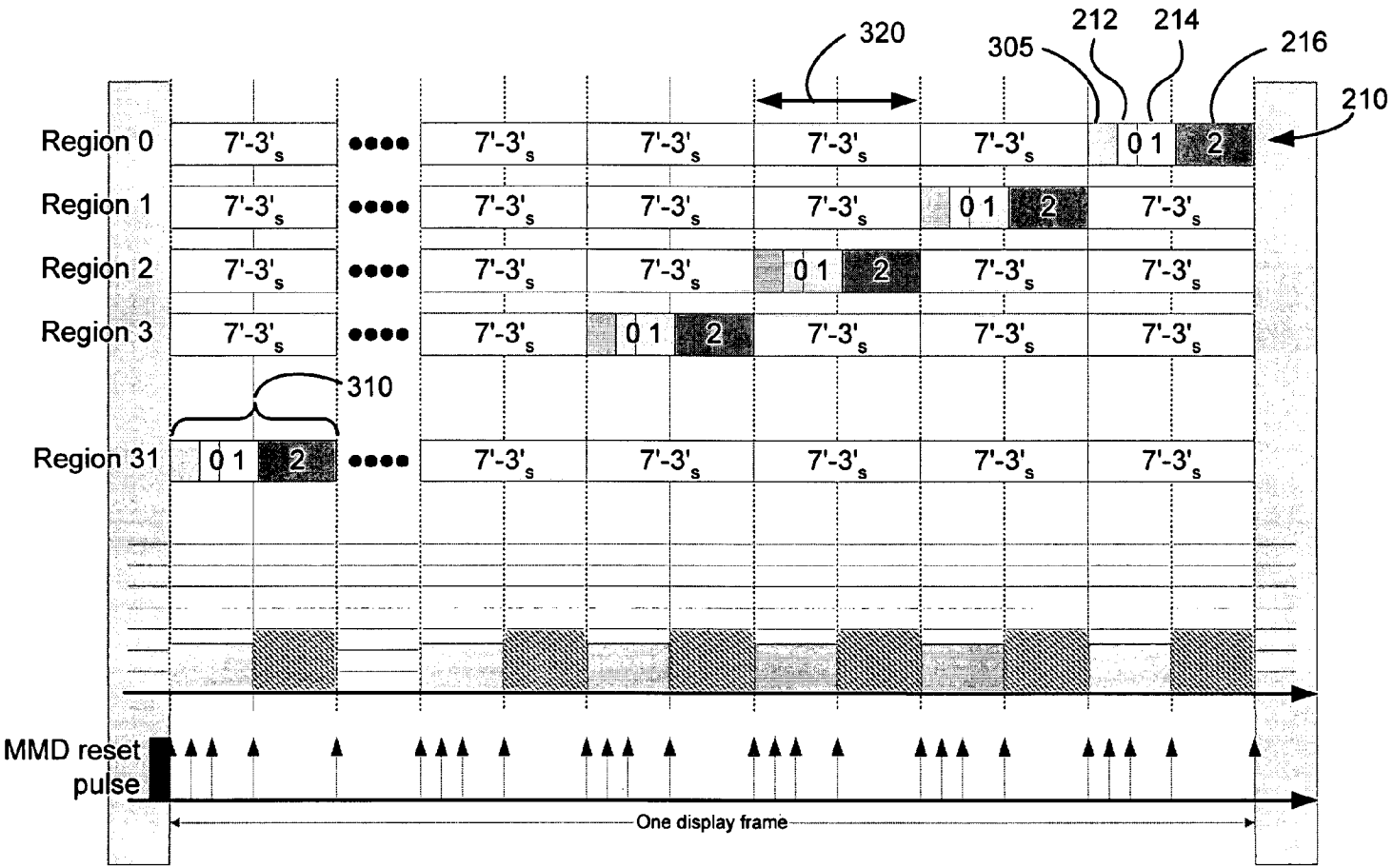
FIG. 3 is a simplified field pulse diagram of an expanded even length bit plane PWM technique according to an embodiment of the present invention.

FIG. 3 is a simplified field pulse diagram of an expanded fractional bit plane PWM technique according to an embodiment of the present invention. As illustrated in FIG. 3, a PWM sequence extending over a duration of one field duration (or display frame) is provided according to embodiments of the present invention. The field duration is related to the refresh rate of the display and is typically about 16.7 ms for commercially available displays. Of course, embodiments of the present invention are not limited to field durations of 16.7 ms, but include other field durations within the scope of the present invention. The PWM sequence comprises a number of bit planes that are associated with a number of regions (e.g. 32 regions as shown in FIG. 3). In some embodiments, the regions correspond to particular regions of a display device.

Referring to region 0 of FIG. 3, bit plane 210 includes an LSB 212, a first intermediate bit 214, a second intermediate bit 216, and a fractional bit 305. In a specific embodiment, the temporal length of the LSB 212 is equal to one LSB unit ($t_0$) and the temporal length of the fractional bit 305 is equal to a value of F times $t_0$. In embodiments of the present invention, the value F is a predetermined value. In a particular embodiment, the value of F is 1.5. In other embodiments, the value of F ranges from about 0.5 to about 3.5. Merely by way of example, embodiments of the present invention utilize values of F of 1.0, 1.25, 1.5, 1.75, 2.25, 2.5, and 2.75.

Referring to FIG. 2A, the additional LSB 220 represents an exemplary embodiment in which the value of F associated with the fractional bit 220 is equal to one. Alternative embodiments provide a range of values for F as described above. As illustrated in FIG. 3, bits 212, 214, 216, and 305 initially form a bit grouping 310 of length equal to $(7+F)t_0$. In embodiments of the present invention in which the value of F=1, the initial length of the bit grouping 310 is equal to $8t_0$, providing 32 bit groupings characterized by equal temporal lengths in bit plane 210. As illustrated in FIG. 3, the 32 equal length bit groupings can be shuffled to reduce system bandwidths.

For an embodiment in which the value of F is greater than one, the bit grouping 310 is longer than $8t_0$. In these embodiments, the temporal length of bit grouping 310, as well as the split bits represented by the symbols 7'-3'$_s$, are normalized to decrease their temporal extent to a value equal to 8 $t_0$. For example, in an embodiment in which F=1.5, bit grouping 310 has a length of $8.5t_0$. Adding an extra $0.5t_0$ each of the other 31 bit segments results in a total increase in the bit plane 210 of $16t_0$. For the 256 shades of gray scale associated with bit plane 210, this additional $16t_0$ is removed by multiplying each of the bit groupings by $256/(256+16)\approx0.941$ to normalize each of the bit groupings to a length of 8 times the original LSB duration. After the normalization process, the length 320 of the bit segments is 8 times the original LSB duration, preserving the display frame time. Thus, in some embodiments, minor shrinkage of the bit segments is utilized to modify the length of the bit plane 310 to a value equal to the shuffling unit 320. As illustrated in FIG. 3, the full display data load segment is represented by bit plane 310.

As will be evident to one of skill in the art, the insertion of the fractional bit 305 provides a mechanism to enhance the gray scale resolution provided by a system operating at a given data rate. For example, through the use of a fractional bit with an F value equal to 1.5, the gray scale resolution is increased by providing a bit length between the LSB 212 (normalized gray scale resolution value of 1) and the next intermediate bit 214 (normalized gray scale resolution value of 2). Table 1 illustrates a number of gray scale values that are provided according to embodiments of the present invention. As illustrated in Table 1, the bit sequence 0, F, 1 provides a gray scale resolution of 3.5 for F=1.5. Thus, the use of the additional fractional bit results in enhanced gray scale resolution for a given data rate.

TABLE 1

| Bit Sequence | Gray Scale Value (Normalized) |
|---|---|
| 0 | 1 |
| F | 1.5 |
| 1 | 2 |
| 0, F | 2.5 |
| 0, 1 | 3 |
| F, 1 | 3.5 |
| 2 | 4 |
| 0, F, 1 | 4.5 |
| 0, 2 | 5 |
| F, 2 | 5.5 |

In alternative embodiments, the values of F selected for the fractional bit provide for modification of the gray scale resolution in accordance with the value selected for the F value. Multiple fractional bits are used in some applications. Merely by way of example, fractional bit values associated with normalized gray scale values of 1.25, 1.75, 2.25, and others, are provided through embodiments of the present invention.

As illustrated in FIG. 3, the bit grouping 310 is time shifted, also referred to as shuffling, to appear at different times in different regions. Thus, in Region 0, bit grouping 310 is at the end of the display frame, whereas in Region 31, bit grouping 310 appears as the first bit group in the sequence. Additionally, the bit groupings labeled 7'-3'$_s$ are shuffled to reduce the system bandwidth as will be evident to one of skill in the art. Although bit grouping 310 is time shifted in a linear manner as a function of region, this is not required by the present invention. In alternative embodiments, bit grouping 310 is time shifted in other manners as a function of the region. Moreover, although 32 regions are illustrated in FIG. 3, other embodiments utilize a greater or lesser number of regions depending on the particular applications. One of ordinary skill in the art would recognize many variations, modifications, and alternatives.

Figure 4:
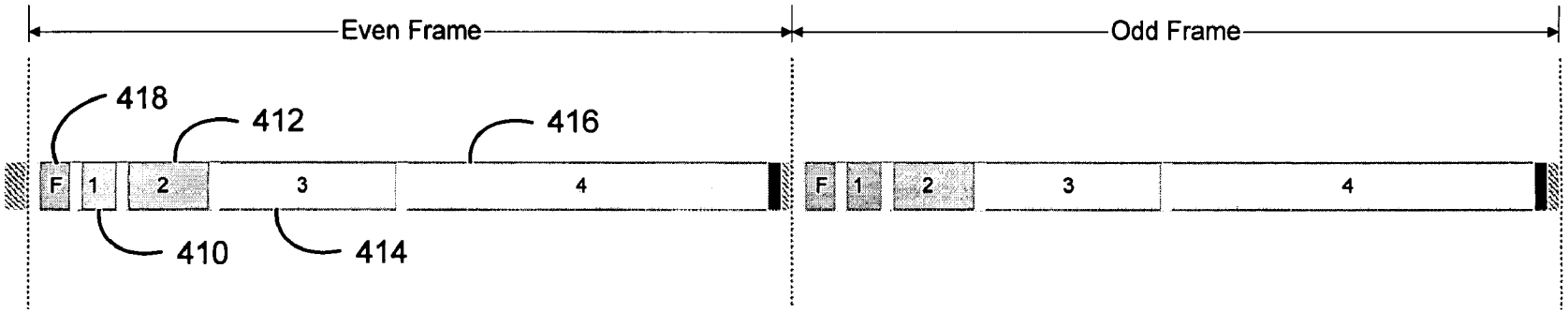
FIG. 4 is a simplified field pulse diagram of a frame modulation PWM technique according to an embodiment of the present invention.

FIG. 4 is a simplified field pulse diagram of a frame modulation PWM technique according to an embodiment of the present invention. FIG. 4 illustrates a first frame (even frame) and a second frame (odd frame) sequenced in time. Display data handler hardware is used to blank out the fractional bit every other frame. The minimum bit plane duration has been increased from a value associated with LSB "0" of length equal to $t_0$ a length of $Ft_0$, as represented by fractional bit F (418). Conventional bits 412, 414, and 416 are illustrated in FIG. 4. The increase in minimum bit plane duration reduces the maximum data rate associated with the PWM system. In particular embodiments, the value of F includes values ranging from about 1.25 to about 3.5. Additionally, the temporal length associated with a display frame can be maintained at an original value by scaling the bits in the even and odd frames by an appropriate value in a manner similar to that discussed with respect to FIG. 3.

At the same time, the gray scale resolution provided by embodiments of the present invention approximately equals the gray scale resolution of techniques associated with twice the data rate of embodiments of the present invention. As will be evident to one of skill in the art, although the LSB "0" with a gray scale value of one unit is not provided by the technique illustrated in FIG. 4, the gray scale resolution values associated with each frame that are available through embodiments of the present invention in which F=1.5 include values based on bits with gray scale values of 1.5, 2, 4, 8, 16, etc. and combinations thereof. As a result, gray scale values for the frame of 1.5, 2, 3.5, 4, 5.5, 6, 7.5, 8, 9.5, etc. are provided through particular embodiments such as that illustrated by the even frame in FIG. 4.

In some embodiments, frame modulation is used to further increase the available gray scale resolution by averaging the gray scale resolution of adjacent frames. In a specific embodiment, the fractional bit 418 is modulated between alternating values in alternating frames. For example, the fractional bit 418 is turned "ON" in an even frame and turned "OFF" in an odd frame. Averaging the value of the fractional bit over two frames provides an intermediate bit intensity equal to one half of the fractional bit plane value. Thus, in the embodiment illustrated in FIG. 4, a frame modulated value of 0.75 is associated with the fractional bits, providing gray scale resolution values of 0.75, 2, 4, 8, 16, etc. and combinations thereof.

Figure 5:
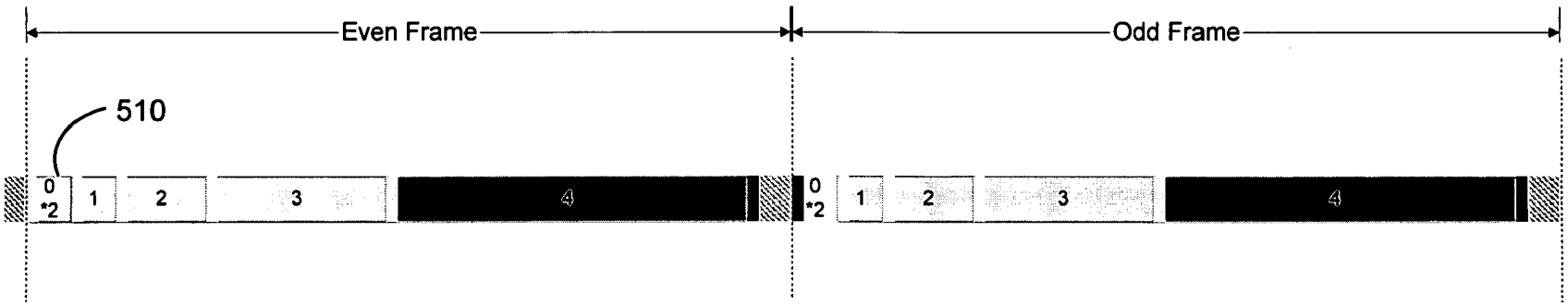
FIG. 5 is a simplified field pulse diagram of another frame modulation PWM technique provided according to an alternative embodiment of the present invention.

FIG. 5 is a simplified field pulse diagram of another frame modulation PWM technique provided according to an alternative embodiment of the present invention. As in FIG. 4, FIG. 5 illustrates a first frame (even frame) and a second frame (odd frame) sequenced in time. Display data handler hardware is used to blank out the fractional bit every other frame. In the embodiment illustrated in FIG. 5, a fractional bit with a length equal to the LSB is provided and the combination 510 of the LSB and the fractional bit of equal length is illustrated by the symbol 0*2. The maximum data rate for the PWM sequence illustrated in FIG. 5 is reduced since the minimum bit plane duration is equal to 2 LSB units, associated with the combination bit 510 and bit "1." Additionally, the temporal length associated with a display frame can be maintained at an original value by scaling the bits in the even and odd frames by an appropriate value in a manner similar to that discussed with respect to FIGS. 3 and 4.

Averaging the value of the fractional bit over two frames provides an intermediate bit intensity equal to the value of the LSB. Thus, the embodiment according to the present invention illustrated in FIG. 5 provides gray scale resolution values of 1, 2, 4, 8, 16, etc. and combinations thereof. Referring to FIG. 5, the minimum bit plane duration is illustrated by reference number 510 and is equal to twice the minimum bit plane duration of systems using a "0" bit. Therefore, the use of frame modulation techniques and the fractional bit illustrated throughout the present specification provides a number of gray scale resolution values typically associated with data rates twice those employed by embodiments of the present invention.

Figure 6:
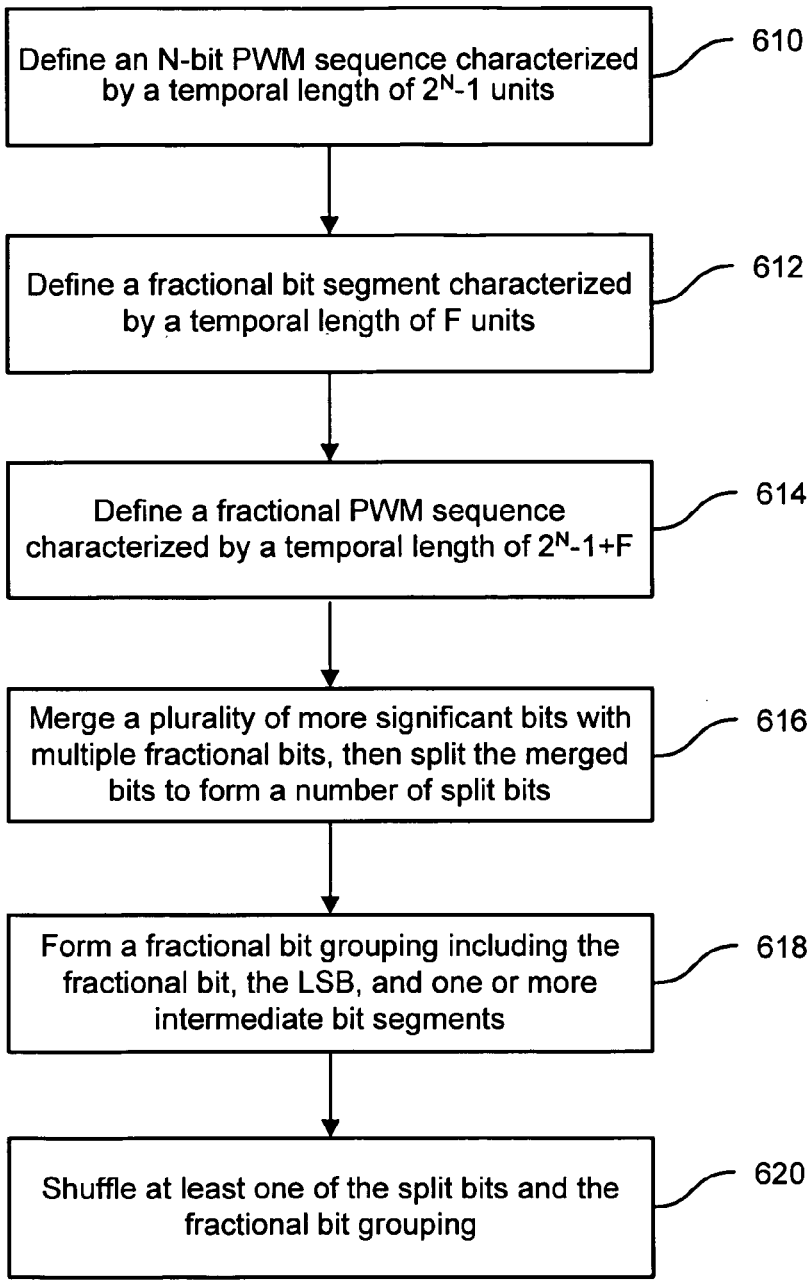
FIG. 6 is a simplified flowchart illustrating a method of providing a PWM sequence according to an embodiment of the present invention.

FIG. 6 is a simplified flowchart illustrating a method of providing a PWM sequence according to an embodiment of the present invention. In some embodiments, the method enhances the gray scale resolution of a PWM system. An N-bit PWM sequence is defined (610). The N-bit PWM sequence includes an LSB characterized by a temporal length of one unit, generally referred to as $t_0$. Accordingly, the N-bit PWM sequence is characterized by a temporal length of $2^N-1$ units. A fractional bit segment is defined (612) with a length of F units. The value of F varies in particular embodiments depending on the particular application. Merely by way of example, values of F including 0.5, 0.75, 1.0, 1.25, 1.5, and 1.75 are included according to specific embodiments of the present invention.

A fractional PWM sequence is defined (614). The fractional PWM sequence includes the N-bit PWM sequence and the fractional bit segment characterized by a temporal length F. Thus, the temporal length of the fractional PWM sequence is equal to $2^N-1+F$ units.

According to some embodiments, a plurality of more significant bits (length greater than $t_0$) are merged with fractional bits and then split using bit splitting techniques (616) to form a number of new split bit planes that may have different durations from the original bit planes. In a particular embodiment, all bits with length greater than $8t_0$ are merged with 31 $(F-1)t_0$ length bits and split into segments with a length greater than or equal to $8t_0$. A fractional bit grouping is formed (618) by combining the fractional bit segment, the LSB, and one or more intermediate bit segments. In a particular embodiment, F=1 and the fractional bit has a length equal to the LSB. In this particular embodiment, the fractional bit grouping can include two intermediate bit segments (one with a length of $2t_0$ and the other with a length of $4t_0$) so that the length of the fractional bit grouping is equal to $8t_0$. One or more of the split bits and the fractional bit grouping are shuffled in time (620) to reduce the maximum system bandwidth in some embodiments of the present invention.

It should be appreciated that the specific steps illustrated in FIG. 6 provide a particular method of enhancing gray scale resolution of a PWM system according to an embodiment of the present invention. Other sequences of steps may also be performed according to alternative embodiments. For example, alternative embodiments of the present invention may perform the steps outlined above in a different order. Moreover, the individual steps illustrated in FIG. 6 may include multiple sub-steps that may be performed in various sequences as appropriate to the individual step. Furthermore, additional steps may be added or removed depending on the particular applications. Merely by way of example, in some embodiments, bit splitting (616), formation of the fractional bit grouping (618) and shuffling of split bits and the fractional bit grouping (620) are optional. One of ordinary skill in the art would recognize many variations, modifications, and alternatives.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method of enhancing the gray scale resolution of a frame in a PWM system, the method comprising:

defining an first N-bit PWM sequence with a length of $2^N-1$ units, wherein the first N-bit PWM sequence includes a least significant bit (LSB) segment characterized by a temporal length of one unit, a first bit segment characterized by a temporal length of the LSB segment, a second bit segment characterized by a temporal length of 4 times the LSB segment, and a third bit segment characterized by a temporal length of 8 times the LSB segment;

adding an additional bit segment of temporal length F to the first N-bit PWM sequence, wherein the additional bit segment has value of zero;

forming a second PWM sequence characterized by a temporal length of $2^N-1+F$;

bit-splitting the second PWM sequence into a plurality of segments, each of the plurality of segments having a length equal to 4 times the length of the LSB segment, wherein the plurality of segments include:

a first segment comprising the additional bit segment, the LSB segment, and the first bit segment;

a second segment comprising the second bit segment;

a third segment comprising a first portion of the third bit segment; and a fourth segment comprising a second portion of the third bit segment.

2. The method of claim 1 wherein F is equal to the length of the LSB segment.

3. The method of claim 1 wherein F is 0.5 times the length of the LSB segment.

4. The method of claim 3 wherein the length of the LSB segment and the first bit segment is normalized to generate the first segment.

5. The method of claim 4 wherein the normalization comprises adjusting the length of the LSB segment or the first bit segment.

6. The method of claim 5 wherein adjusting comprises increasing the length of the LSB segment or the first bit segment to generate the first segment.

* * * * *